United States Patent [19]

Schwinn et al.

[11] 4,187,056

[45] Feb. 5, 1980

[54] FAN BLADE ASSEMBLY AND COUPLING

[75] Inventors: Joseph M. Schwinn, Windsor; Tony E. Maynard, Santa Rosa, both of Calif.

[73] Assignee: Ecodyne Corporation, Lincolnshire, Ill.

[21] Appl. No.: 891,220

[22] Filed: Mar. 29, 1978

Related U.S. Application Data

[63] Continuation-in-part of Ser. No. 792,740, May 2, 1977, abandoned.

[51] Int. Cl.[2] ..... F04D 29/36

[52] U.S. Cl. ..... 416/207; 416/210 R

[58] Field of Search ..... 416/207, 208, 209, 210 R; 403/314, 373, 374

[56] References Cited

U.S. PATENT DOCUMENTS

| | | | |
|---|---|---|---|
| 2,573,875 | 11/1951 | Riddiford | 416/207 |
| 2,765,859 | 10/1956 | Hartzell et al. | 416/207 |
| 2,844,207 | 7/1958 | Curley | 416/207 |
| 2,981,338 | 4/1961 | Hindmarch | 416/207 X |
| 3,324,953 | 6/1967 | Greenhill | 416/207 X |
| 3,545,884 | 12/1970 | Schroeter et al. | 416/207 X |
| 3,984,194 | 10/1976 | Fermer et al. | 416/207 X |

FOREIGN PATENT DOCUMENTS

| | | | |
|---|---|---|---|
| 520194 | 6/1953 | Belgium | 416/207 |
| 167599 | 11/1965 | U.S.S.R. | 416/207 |

*Primary Examiner*—Everette A. Powell, Jr.
*Attorney, Agent, or Firm*—Joel E. Siegel; Charles M. Kaplan

[57] ABSTRACT

A fan blade is adjustably connected to a power driven shaft by means of a hollow coupling with a flat bearing surface on its inside face, and surrounding a hole through its radially outer face. The fan blade shank extends through the hole and is captured by a split ring that has a rim which is compressed against the inside bearing surface by a shoulder on the shank. A removable yoke is held against the blade shaft or shoulder by bolts which pass through the coupling's radially outer face, span the rims and shoulder, and engage into tapped holes in the yoke.

27 Claims, 7 Drawing Figures

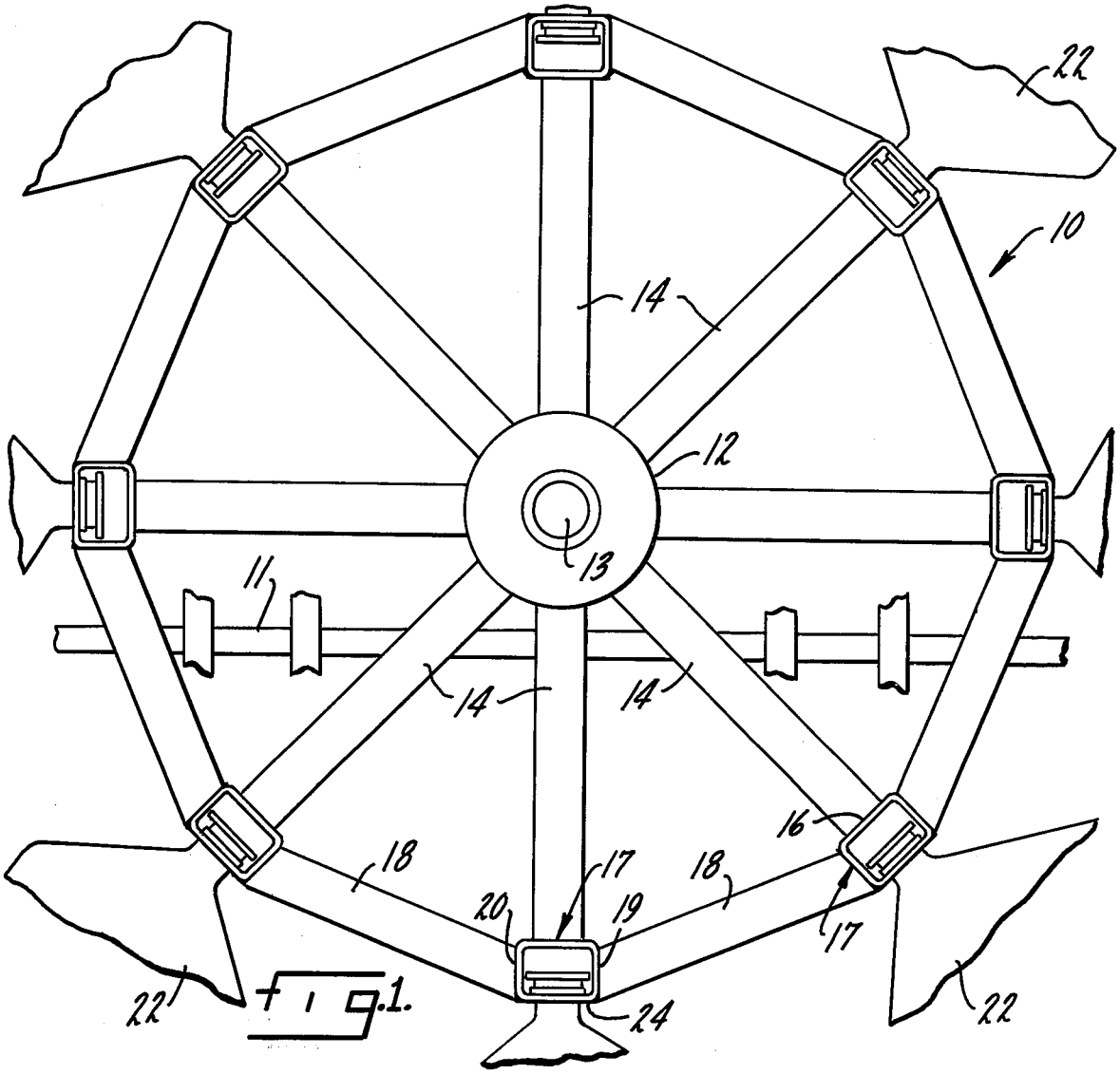
fig.1.
fig.2.
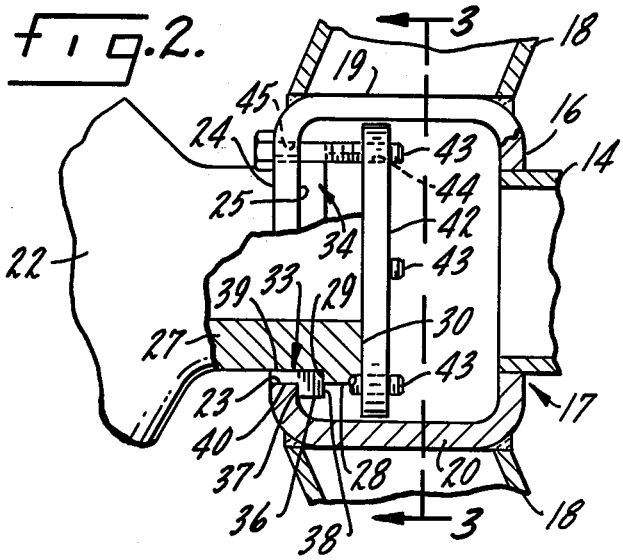
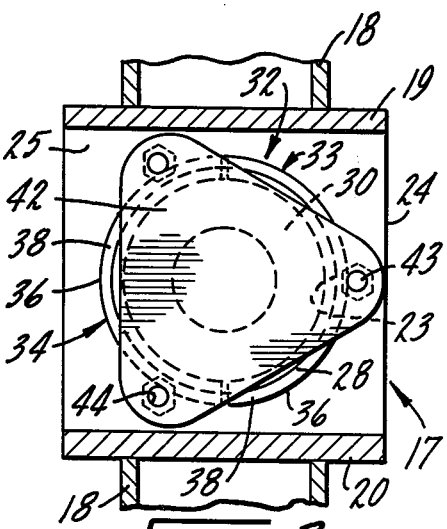
fig.3.

Fig.4.
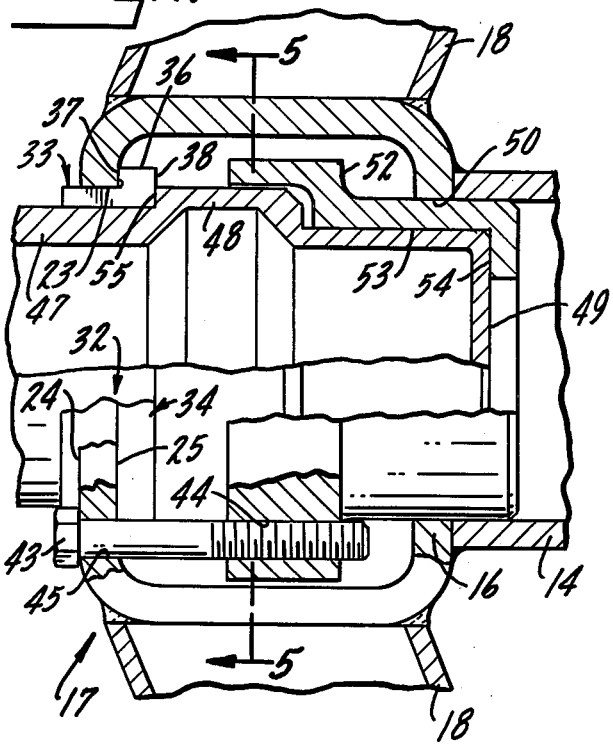
Fig.5.
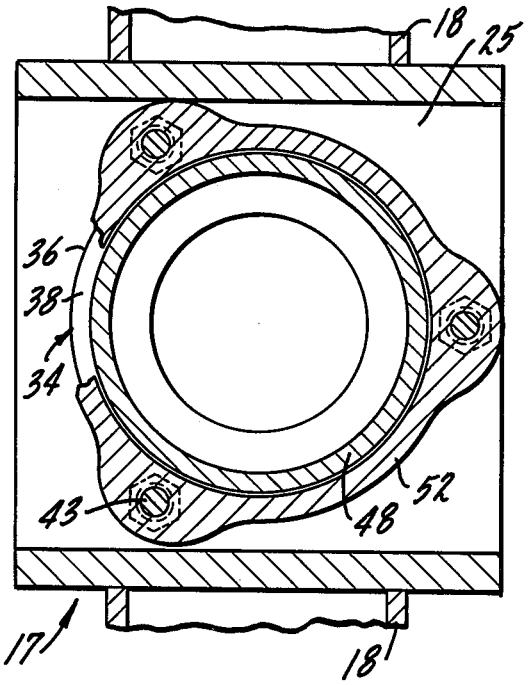
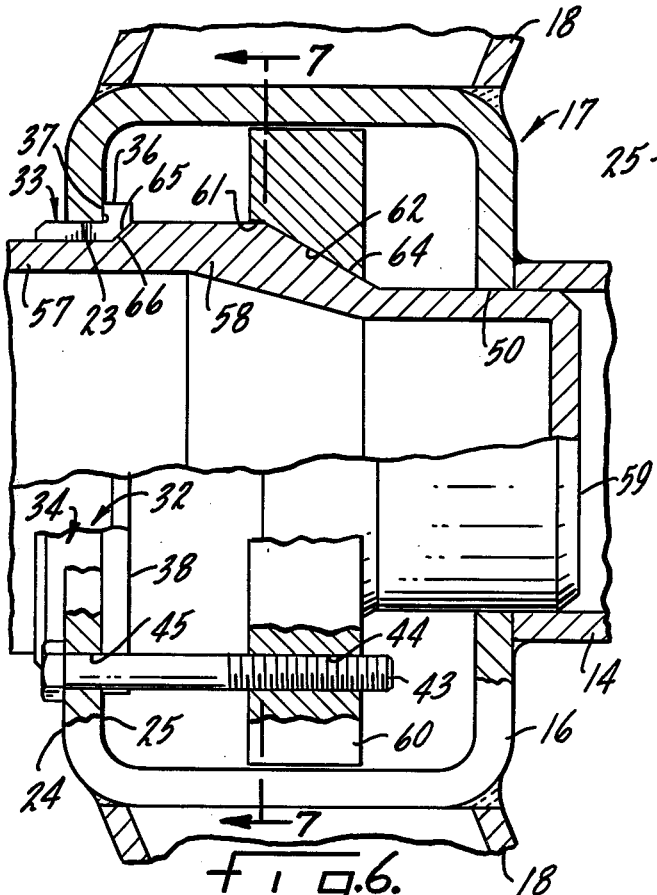
Fig.6.
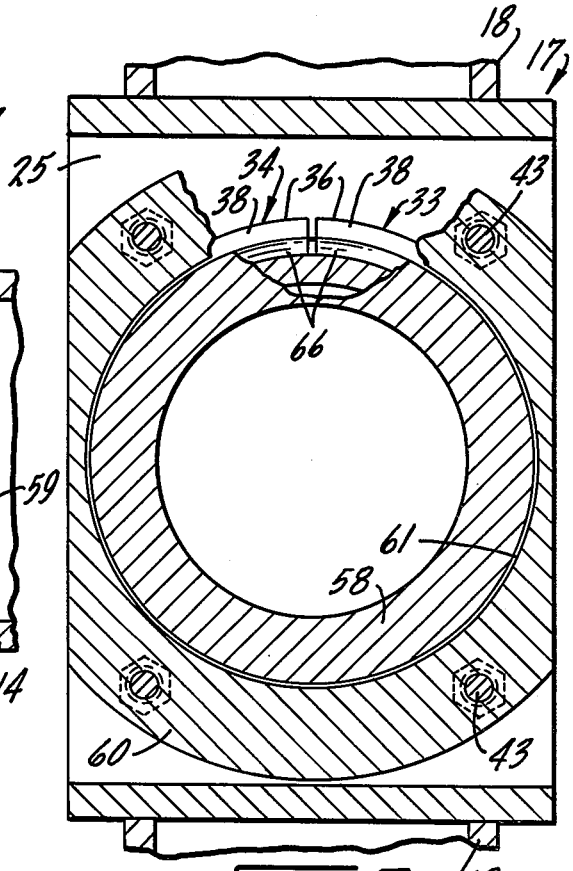
Fig.7.

FAN BLADE ASSEMBLY AND COUPLING

BACKGROUND OF THE INVENTION

This application is a Continuation-In-Part of United States application for Letters Patent Ser. No. 792,740 filed May 2, 1977, now abandoned.

This invention relates to fan blade couplings, and more particularly to a coupling arrangement for assembling numerous blades into a large diameter, horizontal fan assembly for a mechanical draft liquid cooling tower. Horizontal fans for mechanical draft cooling towers usually have large diameters (e.g., 20–30 feet). Such blades rotate at speeds which subject them to significant stress, vibration and fatique loads. Yet these blades must be mounted in a way which permits blade replacement and universal adjustment of blade pitch by field workmen. Prior art couplings for attaching such blades to a driven hub had parts which had to be machined to precise tolerances, and special tools had to be employed to assemble, disassemble, or adjust such fan blades. The force holding such prior art fan blade assemblies together was frequently supplied by compression fasteners, which are more easily loosened than tension fasteners by the stresses encountered. Also, the length of such blades could not be easily adjusted when wear or warping of the equipment necessitated such a change.

OBJECTIVES OF THE INVENTION

Accordingly, it is an object of this invention to provide an improved variable pitch fan blade coupling and assembly.

Another object is to provide a fan blade coupling that does not require the use of special tools.

Another object is to provide a fan blade coupling that does not require any parts to snap into a groove.

Another object is to provide an adjustable fan blade assembly held together by fasteners in tension.

Another object is to provide a fan blade assembly that uses shims to modify blade tip clearance.

Another object is to provide an adjustable pitch and length fan blade assembly made from simple parts.

Another object is to provide a rugged, durable, easily adjusted and maintained fan blade assembly for a liquid cooling tower that has a relatively modest cost, and which does not possess defects found in similar prior art structures.

Other objects and advantages of the invention will be found in the specification and claims, and the scope of the invention will be set forth in the claims.

DESCRIPTION OF THE DRAWINGS

FIG. 1 is a partially broken away, top plan view of a fan assembly in accord with the invention.

FIG. 2 is an enlarged, partially cross sectional top plan view of a coupling and blade end from FIG. 1

FIG. 3 is a cross sectional view taken along the line 3—3 in FIG. 2.

FIG. 4 is an enlarged, partially cross sectional top plan view of another embodiment of a coupling and blade end usable in the assembly of FIG. 1.

FIG. 5 is a cross sectional, partially broken away view taken along the line 5—5 in FIG. 4.

FIG. 6 is an enlarged, partially cross sectional top plan view of another embodiment of a coupling and blade end usable in the assembly of FIG. 1.

FIG. 7 is a cross sectional, partially broken away view taken along the line 7—7 in FIG. 6.

DESCRIPTION OF THE INVENTION

The drawing shows a large diameter, horizontal fan assembly 10 used to pull air through the fill 11 of a mechanical draft water cooling tower. Hub 12 is connected to a shaft 13, which is rotated by a suitable motor (not illustrated). A plurality of radial spokes 14 extend outwardly from hub 12 and are welded at their outer ends to the radially innermost side 16 of a coupling housing 17. A plurality of circumferential spokes 18 are welded to the opposite lateral sides 19 and 20 of each housing 17. Circumferential spokes 18 thus connect radial spokes 14 into a rigid framework for transmitting the power of shaft 13 to a plurality of fan blades 22.

Coupling housings 17 are hollow and are rectangular in cross section in planes perpendicular to the longitudinal axis of the spokes 14 to which they are attached. The top and bottom of housings 17 are open in planes parallel to such spoke axis, and housings 17 are generally rectangular in cross section in such planes. There is a first circular hole 23 through the center of the radially outermost side 24 of each housing 17. The radially innermost surface 25 of each side 24 is flat and smooth adjacent to hole 23 and thus defines a flat bearing surface on the inside of housing 17 surrounding hole 23. Bearing surface 25 lies in a plane perpendicular to the axis of spoke 14.

As shown in FIGS. 2 and 3, each fan blade 22 may have a radially inwardly directed, right circular cylindrical end shank 27 with an enlarged circular shoulder 28 at its terminal end. A radially outwardly directed flat bearing surface 29 projects around shank 27, and a similar flat bearing surface 30 of shoulder 28 faces inwardly around shank 27. Bearing surfaces 29 and 30 lie in planes that are perpendicular to the longitudinal centroidal axis of shank 27; such axis of shank 27 is essentially aligned with the longitudinal axis of spoke 14. Shoulder 28 and a portion of shank 27 pass through hole 23 into housing 17.

A split ring 32 includes a pair of identical, separate, semicircular members 33 and 34. Members 33 and 34 may be placed in housing 17 through an open end, or through hole 23 before the blade shank 27 is inserted. Each member 33 or 34 has an enlarged, outwardly protruding circular rim 36, which defines a radially outwardly directed flat bearing surface 37 and an inwardly directed flat bearing surface 38. Flat bearing surfaces 37 and 38 lie in parallel planes which are perpendicular to the aforementioned axes of shank 27 and spoke 14. Split ring 32 surrounds shank 27 and substantially fills hole 23 with its inner surface 39 in contact with shank 27 and its outer surface 40 in contact with the surface of hole 23. Bearing surface 37 contacts the flat bearing surface 25 of housing 17, and bearing surface 38 contacts bearing surface 29 of shoulder 28.

Yoke means comprising a substantially triangular flat plate 42 is dimensioned to be removable through an open side of housing 17 with its corners projecting beyond rim 36 when plate 42 is inside housing 17. Three bolts 43 are threaded into tapped holes 44 which are located in each of the corners of plate 42. Bolts 43 pass through apertures 45 located in radially outermost side 24 of housing 17 around hole 23. The spacing and orientation of apertures 45 corresponds to that of tapped holes 44 so that holes 44 and apertures 45 can be aligned to receive the three bolts 43. Bolts 43 span shoulder 28 and split ring members 33 and 34 on the inside of housing 17. Tightening of bolts 43 in holes 44 places the bolts in tension and forces plate 42 against flat bearing surface 30 of shoulder 28, and this causes the rims 36 of split ring members 33 and 34 to be compressed between flat bearing surface 25 around hole 23 and flat bearing surface 29 of shoulder 28. Split ring 32 prevents blade shoulder 28 from escaping through hole 23 and locks blade 22 in the chosen pitch angle.

FIGS. 4 and 5 show another embodiment of the invention identical in many respects to the embodiment of FIGS. 1–3, so the same reference numerals are used where appropriate. Each blade 22 may have a radially inwardly directed circular end shank portion 47 with an enlarged circular shoulder 48 spaced radially outwardly from its terminal end 49. Shank 47 passes through first hole 23 and end 49 extends through a second circular hole 50 in the radially innermost side 16 of each housing 17. Holes 23 and 50 are coaxial. Yoke means comprising a receptacle 52 having an opening 53 receives and surrounds end 49. Receptacle 52 also extends through second hole 50 and substantially fills hole 50; this provides additional bearing surface supporting blades 22. The bottom 54 of opening 53 bears against end 49.

A flat bearing surface 55 on shoulder 48 is compressed directly against the flat bearing surface 38 on the rims 36 of a pair of identical, separate semicircular members 33 and 34, which define a split ring 32. Ring 32 surrounds shank 47 and substantially fills first hole 23. Ring 32 may protrude radially outwardly beyond housing 17. Flat surface 37 of each rim 36 contacts the flat bearing surface 25 of housing 17 around hole 23. Three bolts 43 pass through apertures 45 in side 24 and are threaded into tapped holes 44 in receptacle 52. Tightening of bolts 43 places the bolts in tension and forces the bottom 54 of receptacle 52 against the terminal end 49 of shank 47; this forces the surface 55 of shoulder 48 against the surface 38 of rims 33 and 34, which compresses the rims against flat surface 25 around hole 23. Ring 32 prevents shoulder 48 from escaping through hole 23 and locks blade 22 in chosen pitch angle.

FIGS. 6 and 7 show another embodiment of the invention identical in many respects to the embodiments of FIGS. 1–3 and 4 and 6, so the same reference numerals are used where appropriate. Each blade 22 may have radially inwardly directed circular end shank portion 57 with an enlarged circular shoulder 58 spaced radially outwardly from its terminal end 59. Shank 57 passes through first hole 23 and end 59 extends through and substantially fills second circular hole 50 in the radially innermost side 16 of each housing 17. Holes 23 and 50 are coaxial and provide bearing surfaces supporting blades 22.

Yoke means comprising plate means 60 receives and surrounds shank 57 through an opening 61 having a conical surface 62 which tapers radially inwardly. Conical surface 62 bears against and mates with a correspondingly tapered conical surface 64 on the radially inner side of shoulder 58. The outer side of shoulder 58 has a conical surface 65 which tapers radially outwardly. Conical surface 65 bears against and mates with a correspondingly tapered conical surface 66 on the rims 36 of a pair of identical, separate semicircular members 33 and 34 which define a split ring 32. Ring 32 surronds shank 57, substantially fills first hole 23, and may protrude radially outwardly beyond housing 17. Flat surface 37 of each rim 36 contacts the flat bearing surface 25 of housing 17 around hole 23.

A plurality of bolts 43 pass through apertures 45 in side 24 and are threaded into tapped holes 44 in plate 60. Tightening of bolts 43 places the bolts in tension and forces conical surface 62 of plate 60 against the mating conical surface 64 of shoulder 58; this forces the conical surface 65 on the other side of shoulder 58 against the mating conical surface 66 on rims 36 of split ring 32. Rims 36 are compressed against flat surface 25 around hole 23. Ring 32 prevents shoulder 58 from escaping through hole 23 and locks blade 22 in the chosen pitch angle.

It has thus been shown that by the practice of this invention a large diameter adjustable fan blade may be assembled from simple parts. This fan blade assembly can be put together, taken apart, and the blade pitch angle can be adjusted from the easily accessible radially outer end of housing 17 with only a common wrench for gripping the heads of bolts 43. The radial length or tip clearance of any blade 22 may be easily adjusted by inserting shims (not illustrated) between split ring 32 and bearing surface 25. Bolts 43 are pre-loaded in tension, thus assuring that no load redistribution will occur due to cyclic loading, and ensuring against loosening in a fatigue mode.

While the present invention has been described with reference to particular embodiments, it is not intended to illustrate or described herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. A fan blade assembly comprising:

(a) a hub adapted to be connected to a power driven shaft, a plurality of radial spokes extending outwardly from said hub, a hollow coupling housing attached on one side to the radially outer end of each radial spoke, there being a hole through the radially opposite side of each housing, circumferential spokes connecting adjacent radial spokes;

(b) a fan blade connected to each housing, each blade having a radially inwardly directed end shank portion with an enlarged shoulder extending into one of said housings through its hole; and (c) means for attaching each blade to its coupling housing comprising, a split ring comprising a pair of separate members each having an outwardly protruding rim, each pair of members extending through the hole in one of said housings with their rims held in abutment against the inside of said housing around its hole by the shoulder of its associated blade, said members encircling said shank portion of such blade and substantially filling said hole around said shank portion, and removable yoke means in said housing held in tight frictional engagement against said shank portion by a plurality of fasteners passing through apertures located in said housing and being adjustably connected to said yoke means.

2. The invention defined in claim 1, further comprising said hole being in the radially outermost side of said housing and said apertures being located in said side around said hole.

3. The invention defined in claim 1, further comprising said hole being in the radially outermost side of said housing and the radially innermost surface of said side defining a flat bearing surface on the inside of said housing surrounding said hole and lying in a plane perpendicular to said axis, said rims being held against said bearing surface, and said apertures being located in said radially outermost side around said hole.

4. The invention defined in claim 3, wherein the mating bearing surfaces of said rims and shoulder are conical.

5. The invention defined in claim 3, further comprising said yoke means bearing against the terminal end of said shank portion.

6. The invention defined in claim 5, wherein said yoke means is a flat plate.

7. The invention defined in claim 5, wherein said yoke means receives and surrounds said terminal end.

8. The invention defined in claim 3, further comprising a second hole in the radially innermost side of said housing, said second hole being coaxial with the first mentioned hole, and the terminal end of said shank portion passing through said second hole.

9. The invention defined in claim 8, wherein said shank portion is received in said yoke means.

10. The invention defined in claim 9, wherein said terminal end extends through an aperture in said yoke means, and said yoke means bears against a second shoulder on said shank portion.

11. The invention defined in claim 10, wherein the mating bearing surfaces of said second shoulder and said yoke means are conical.

12. A coupling for connecting a power driven shaft to a fan blade having a shank portion with an enlarged shoulder, said coupling comprising a hollow housing connectable to such shaft and having a hole through its radially outermost side, said blade shank portion and shoulder passing through said hole into the inside of said housing, a split ring surrounding said shank portion comprising a pair of separate members each having an enlarged rim at its radially inner end, said members substantially filling said hole in contact with the outside of said shank portion, said rims being compressed against the inside of said housing around said hole by direct engagement with said blade shoulder, and removable yoke means in said housing held in tight frictional engagement directly against said shank portion by a plurality of fasteners passing through apertures located in said radially outermost side of said housing and adjustably connected to said yoke means.

13. The invention defined in claim 12, wherein said fasteners span said shoulder and said rims on the inside of said housing.

14. The invention defined in claim 13, wherein said fasteners are bolts threaded into tapped holes in said yoke means.

15. The invention defined in claim 14, wherein the mating bearing surfaces of said rims and shoulder are conical.

16. The invention defined in claim 14, wherein the mating bearing surfaces of said rims and shoulder are perpendicular to the longitudinal centroidal axis of said shank portion.

17. The invention defined in claim 14, further comprising said yoke means bearing against the terminal end of said end shank portion.

18. The invention defined in claim 17, wherein said yoke means is a flat plate.

19. The invention defined in claim 17, wherein said yoke means receives and surrounds said terminal end.

20. The invention defined in claim 14, further comprising a second hole in the radially innermost side of said housing, said second hole being coaxial with the first mentioned hole, and the terminal end of said shank portion passing through said second hole.

21. The invention defined in claim 20, wherein said shank portion is received in said yoke means.

22. The invention defined in claim 21, wherein said terminal end extends through an aperture in said yoke means, and said yoke means bears against a second shoulder on said shank portion.

23. The invention defined in claim 22, wherein the mating bearing surfaces of said second shoulder and said yoke means are conical.

24. A fan blade assembly for a mechanical draft liquid cooling tower comprising:

(a) a hub adapted to be connected to a power driven shaft, a plurality of radial spokes extending outwardly from said hub, a hollow coupling housing attached on its radially innermost side to the radially outer end of each radial spoke, each such housing being substantially rectangular in cross section in planes perpendicular to the longitudinal axis of its radial spoke, and said housings being open-sided in a plane parallel to said axis, there being a circular hole through the radially outermost side of each housing, the radially innermost surface of said side defining a flat bearing surface on the inside of said housing surrounding said hole and lying in a plane perpendicular to said axis, and circumferential spokes attached to said housings and connecting adjacent radial spokes;

(b) a fan blade connected to each housing, each blade having a radially inwardly directed, right circular cylindrical end shank with an enlarged, circular shoulder at its terminal end extending into one of said housings through its circular hole, each blade shoulder being in a plane perpendicular to said axis; and (c) means for attaching each blade to its coupling housing comprising a split ring comprising a pair of separate semicircular members each having an outwardly protruding circular rim, each pair of members extending through the hole in one of said housings with their rims compressed in abutment against said flat bearing surface around its hole by the shoulder of its associated blade, said members encircling said shank of such blade and substantially filling said hole around said shank, and removable yoke means in each housing held in tight frictional engagement against the terminal end of each blade by a plurality of bolts passing through holes located in said radially outermost side of such housing around its hole and threaded into tapped holes in said yoke means, said bolts spanning the blade shoulder and the rims of said split ring members on the inside of said housing.

25. A fan blade assembly for a mechanical draft liquid cooling tower comprising;

(a) a hub adapted to be connected to a power driven shaft, a plurality of radial spokes extending outwardly from said hub, a hollow coupling housing attached on its radially innermost side to the radially outer end of each radial spoke, each such housing being substantially rectangular in cross section in planes perpendicular to the longitudinal axis of its radial spoke, and said housings being open-sided in a plane parallel to said axis, there being a first circular hole through the radially outermost side of each housing, the radially innermost surface of said side defining a flat bearing surface on the inside of said housing surrounding said hole and lying in a plane perpendicular to said axis, there being a second circular hole through the radially innermost side of each housing, said first and second holes being coaxial, and circumferential spokes attached to said housings and connecting adjacent radial spokes;

(b) a fan blade connected to each housing, each blade having a radially inwardly directed circular end shank with an enlarged shoulder spaced from its terminal end and extending into one of said housings through its first circular hole, each blade shoulder having radially inwardly and outwardly directed bearing surfaces, and said terminal end of each blade extending through and substantially filling the second hole of its housing; and (c) means for attaching each blade to its coupling housing comprising a split ring comprising a pair of separate semicircular members each having an outwardly protruding circular rim with a bearing surface for mating with the outwardly directed bearing surface of a blade shoulder, each pair of members extending through the first hole in one of said housings with their rims compressed in abutment against said flat bearing surface around its first hole by the mating outwardly directed bearing surface of the shoulder of its associated blade, said members encircling said shank of such blade and substantially filling said first hole around said shank, and removable yoke means in each housing held in tight frictional engagement against the inwardly directed bearing surface of a blade shoulder by a plurality of bolts passing through holes located in said radially outermost side of such housing around its first hole and threaded into tapped holes in said yoke means, said bolts spanning the blade shoulder and the rims of said split ring members on the inside of said housing.

26. The invention defined in claim 25 wherein said radially inwardly and outwardly directed surfaces of said shoulder, and the respective mating surfaces of said members and said yoke are conical.

27. A fan blade assembly for a mechanical draft liquid cooling tower comprising:

(a) a hub adapted to be connected to a power drive shaft, a plurality of radial spokes extending outwardly from said hub, a hollow coupling housing attached on its radially innermost side to the radially outer end of each radial spoke, each such housing being substantially rectangular in cross section in planes perpendicular to the longitudinal axis of its radial spoke, and said housings being open-sided in a plane parallel to said axis, there being a first circular hole through the radially outermost side of each housing, the radially innermost surface of said side defining a flat bearing surface on the inside of said housing surrounding said hole and lying in a plane perpendicular to said axis, there being a second circular hole through the radially innermost side of each housing, said first and second holes being coaxial, and circumferential spokes attached to said housings and connecting adjacent radial spokes;

(b) a fan blade connected to each housing, each blade having a radially inwardly directed circular end shank with an enlarged shoulder spaced from its terminal end and extending into one of said housings through its first circular hole, and said terminal end of each blade extending through the second hole of its housing; and (c) means for attaching each blade to its coupling housing comprising a split ring comprising a pair of separate semicircular members each having an outwardly protruding circular rim, each pair of members extending through the first hole in one of said housings with their rims compressed in abutment against said flat bearing surface around its first hole by the shoulder of its associated blade, said members encircling said shank of such blade and substantially filling said hole around said shank, and removable yoke means in each housing receiving a blade terminal end and extending through and substantially filling the second hole of its housing, each yoke means being held in tight frictional engagement against the terminal end of its blade by a plurality of bolts passing through holes located in said radially outermost side of such housing around its first hole and threaded into tapped holes in said yoke means, said bolts spanning the blade shoulder and the rims of said split ring members on the inside of said housing.

* * * * *